United States Patent [19]

Benton

[11] 3,990,031

[45] Nov. 2, 1976

[54] ELECTRICAL BUSHING CONTAINING A FULL-RANGE CURRENT-LIMITING FUSE

[75] Inventor: Ronald E. Benton, Athens, Ga.

[73] Assignee: Westinghouse Electric Corporation, Pittsburgh, Pa.

[22] Filed: Apr. 17, 1975

[21] Appl. No.: 569,036

[52] U.S. Cl. ..... 337/202; 337/186; 337/204

[51] Int. Cl.[2] ..... H01H 85/02

[58] Field of Search..... 174/17, 73 C, 137, 73 R, 174/139; 317/15, 9, 14 C; 337/202, 186, 204

[56] References Cited

UNITED STATES PATENTS

| | | | |
|---|---|---|---|
| 2,922,927 | 1/1960 | Randabaugh | 317/15 X |
| 3,659,244 | 4/1972 | McKeithan | 337/202 |
| 3,732,517 | 5/1973 | Keto et al. | 315/15 X |

*Primary Examiner*—J D Miller
*Assistant Examiner*—Fred E. Bell
*Attorney, Agent, or Firm*—C. L. McHale

[57] ABSTRACT

A current-limiting fuse capable of interrupting a wide range of current values is located within the bore of a porcelain insulator. One end of the fuse is connected to an outer terminal which is located at one end of the bushing insulator. The other end of the current-limiting fuse is connected to a stud which extends through a retaining washer located at the inside end of the busing insulator. The stud is tightened against the retaining washer to secure the current-limiting fuse and to maintain the retaining washer against the lower end of the bushing insulator. The bore extending through the bushing insulator is enlarged in the region adjacent to the lower end of the current-limiting fuse to permit the placement of an insulating cylindrical sleeve between the bushing insulator and the lower end of the current-limiting fuse. The cylindrical sleeve prevents the lower end of the current-limiting fuse from coming into contact with a semiconducting coating which exists on the inside surface of the bushing insulator. The entire insulator and current-limiting fuse assembly is positioned on the top of a transformer enclosure at an elevation which allows liquid dielectric within the enclosure to extend partially into the lower end of the bushing assembly. The current-limiting fuse is mounted above the liquid dielectric level to assure proper operating characteristics of the current limiting fuse.

2 Claims, 3 Drawing Figures

ELECTRICAL BUSHING CONTAINING A FULL-RANGE CURRENT-LIMITING FUSE

BACKGROUND OF THE INVENTION

1. Field of the Invention

This invention relates, in general, to electrical bushings for transformers and, more specifically, to bushings containing current-limiting fuses.

2. Description of the Prior Art

A wide variety of bushing containing current-limiting fuses have been used in conjunction with electrical apparatus, such as distribution transformers, according to the prior art. In order to satisfactorily protect the transformer and the associated electrical distribution system, it has been usual practice to place a protective link in series with the current-limiting fuse disposed within the bushing assembly. This has been required since the current interrupting characteristics of most prior art current-limiting fuses have been such that only large fault currents could be interrupted by the current-limiting fuse. To provide a full range of primary current protection, it was necessary to install the protective link in series with the current-limiting fuse to interrupt the primary circuit upon the initiation of a fault which causes a current which is too small for interruption by the current-limiting fuse.

Generally, such arrangements have the current-limiting fuse positioned at the upper end of the bushing insulator for the purpose of keeping the current-limiting fuse out of the liquid dielectric of the transformer. This has been required in the prior art because operation of conventional current-limiting fuses disposed directly in the transformer dielectric was not satisfactory. The protective link generally was connected to the lower end of the current-limiting fuse and extended somewhat form the bushing insulator. Due to the construction of the protective link, it has been possible to provide satisfactory performance with the protective link immersed in the liquid dielectric of the transformer.

With the development of a full-range current-limiting fuse which interrupts current from relatively low overload values to extremely high fault current values, it has been possible to provide a fused bushing assembly which does not require a protective link in series with a limited or partial range current-limiting fuse. Thus, the structural supporting arrangements herebefore used with current-limiting fuses and protective links disposed within the bushing insulator are not applicable to a bushing constructed for use with a full-range current-limiting fuse. Therefore, it is desirable, and it is an object of this invention, to provide an arrangement for mounting and securing a full-range current-limiting fuse within the insulating structure of an electrical bushing which is suitable for mounting on the enclosure of a distribution transformer.

SUMMARY OF THE INVENTION

There is disclosed herein a new and useful arrangement for constructing a current-limiting bushing assembly which provides full-range current interrupting capability without the use of a protective link disposed within the bushing insulator. The insulator or insulating structure includes a longitudinal bore which extends between the ends of the insulating structure, with the diameter of the bore enlarged at the lower end of the insulating structure. A full-range current-limiting fuse is disposed within the bore and connected, at one end thereof, to the electrical terminal at the top of the bushing. The other end of the current-limiting fuse is attached to a conductor stud which extends below the lower end of the insulating structure of the bushing.

A cylindrical sleeve constructed of an insulating material is positioned between the bottom end of the current-limiting fuse and the inside surface of the enlarged portion of the bore through the bushing insulator. The cylindrical sleeve helps to keep the current-limiting fuse centered within the bushing insulator and prevents electrical contact between the bottom conducting portion of the current-limiting fuse and a semiconducting coating which is located on the inside surface of the bushing insulator. This semi-conducting coating extends to the bottom of the bushing insulator system and improves the stress distribution on the insulating member of the bushing by effectively increasing the surface area of the high voltage conductor. The voltage gradient and radio interference are effectively reduced by the semiconducting coating.

A retaining washer constructed of an insulating material, such as glass reinforced polyester, is positioned across the bottom end of the bushing insulating structure to retain the cylindrical sleeve within the bushing assembly and to aid in keeping the conductor stud centered within the bushing insulating structure. The conductor stud extends through an opening in the center of the retaining washer and is tightened against the retaining washer by a nut which places the conductor stud under slight axial tension and pulls the retaining washer tightly against the bottom portions of the bushing insulator. Other openings in the retaining washer are provided to allow the liquid dielectric of the transformer to extend into the region between the retaining washer and the lower end of the current-limiting fuse.

BRIEF DESCRIPTION OF THE DRAWING

Further advantages and uses of this invention will become more apparent when considered in the view of the following detailed description and drawing, in which.

DESCRIPTION OF THE PREFERRED EMBODIMENTS

Figure 1:
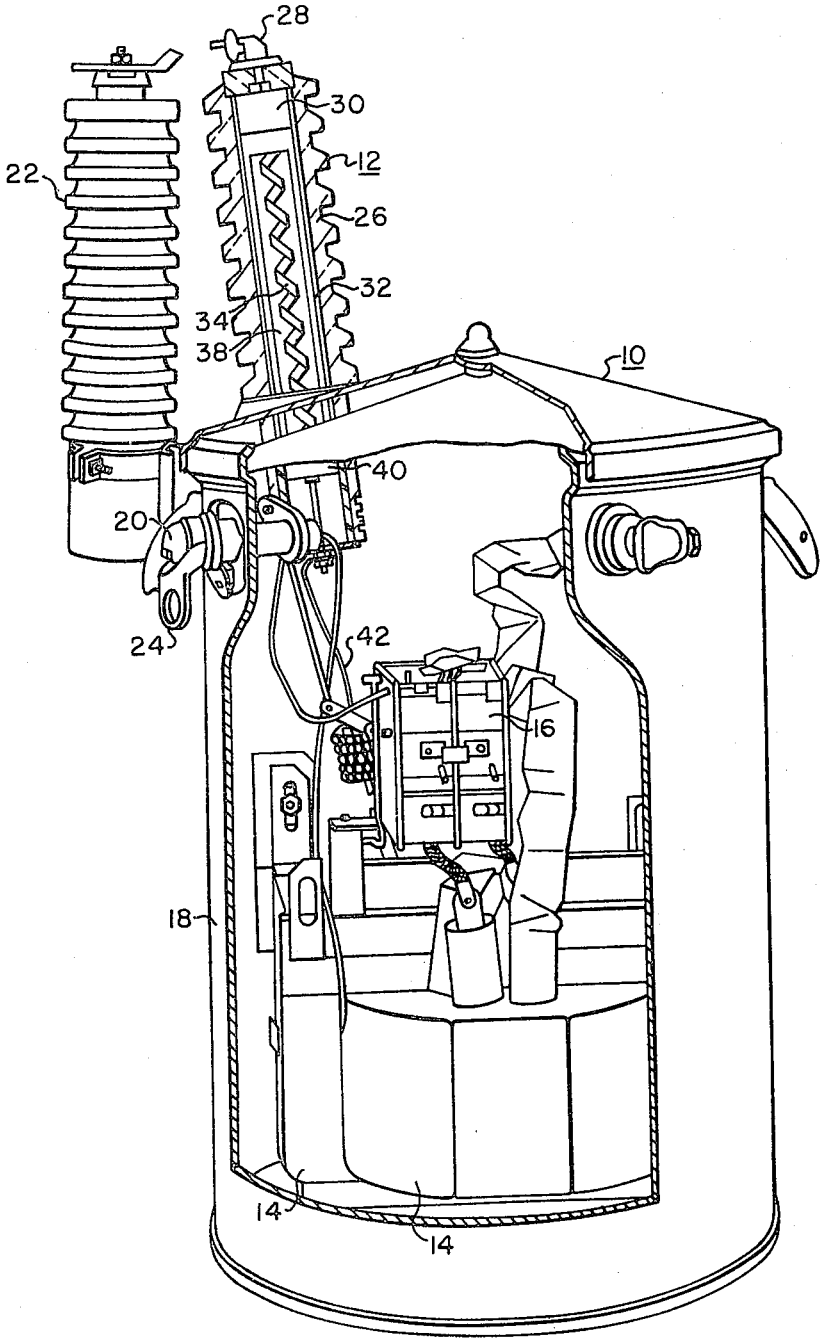
FIG. 1 is a cut-away view of a distribution transformer having a current-limiting bushing assembly constructed according to this invention installed thereon.

Throughout the following description, similar reference characters refer to similar elements or members in all of the figures of the drawing.

Referring now to the drawing, and to FIG. 1 in particular, there is shown a distribution transformer 10 having disposed thereon a current-limiting bushing 12 constructed according to this invention. The transformer 10 includes the core and coil assembly 14 and the secondary circuit breaker 16. These components are contained within the tank or enclosure 18 which normally contains a liquid dielectric, such as mineral oil, to a level which covers the core and coil assembly 14 and the circuit breaker 16 and which extends into the bottom portion of the bushing assembly 12. The transformer 10 in this specific embodiment also includes the signal light 20, the lightning arrestor 22, and a handle 24 for tripping the circuit breaker 16. Although the cut-away view of the transformer 10 illustrates typical components used in a completely self-protecting transformer, it is within the contemplation of this invention that other types of transformers and electrical apparatus may be used in conjunction with the electrical bushing 12.

The bushing 12 includes a bushing insulating structure 26 which is constructed of a suitable insulating material, such as porcelain. The upper or top end of the bushing assembly 12 is terminated with an electrical terminal 28 which is normally used to connect the primary line to the transformer 10. In this specific embodiment, the electrical terminal 28 illustrated is of the "crows-head". The electrical terminal 28 is connected to the upper end 30 of the full-range current-limiting fuse 32. The fuse 32 is constructed to provide a full range of current interrupting capabilities by the use of coordinated elements within the structure of the current-limiting fuse. The silver-foil ribbon 34 which is packed in a high-quality silica sand 38 of controlled grain size is illustrative of the interior of a current-limiting fuse which may be used within the bushing insulating structure 26. The lower end 40 of the fuse 32 is electrically connected to the lead 42 which is connected to the high-voltage winding of the coil assembly 14. Thus, the electrical path between the electrical terminal 28 and the high-voltage winding of the transformer 10 traverses the full-range current-limiting fuse 32 to provide full protection for the transformer components and the associated electrical distribution system.

Figure 2:
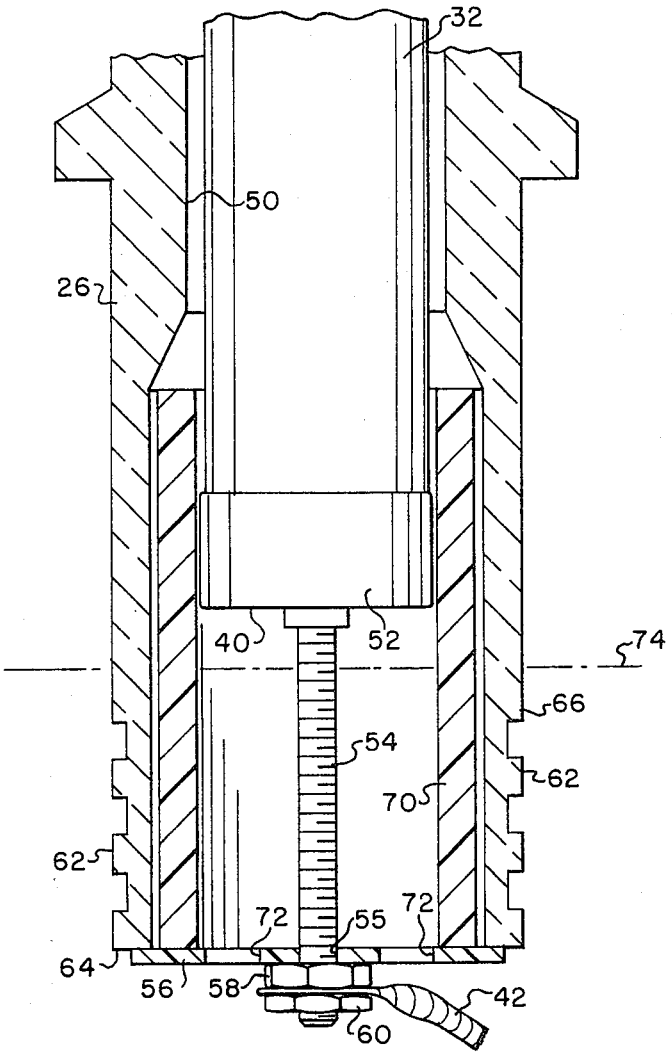
FIG. 2 is a cross-sectional, elevational view of the lower portion of the current-limiting bushing assembly shown in FIG. 1.

FIG. 2 is an enlarged, cross-sectional view of the lower portion of the bushing assembly 12 shown in FIG. 1. The bushing insulating structure 26 contains a bore 50 which extends between the ends of the bushing assembly and in which the current-limiting fuse 32 is positioned. The diameter of the bore 50 is larger at the end of the insulating structure 26 which is adjacent to the lower end 40 of the current-limiting fuse 32. The current-limiting fuse 32 includes a metallic cap 52, located at its lower end 40, to which the conductor stud 54 is connected. The conductor stud 54 extends through an opening 55 in the retaining washer 56 and is placed under axial tension by the tightening of the nut 58. The nut 60 is also engaged with the threads on the conductor stud 54 to provide means for connecting the lead 42 to the conductor stud 54. However, it is within the contemplation of this invention that other connecting arrangements may be used to connect the lead 42 to the conductor stud 54.

The bushing insulating structure 26 includes the sheds 62 which are located adjacent to the lower end 64 of the insulating structure 26 for the purpose of providing increased creepage distance between semiconducting coatings on the insulating structure 26. Although the semiconducting coatings are not illustrated in FIG. 2, normally a semiconducting coating on the outside of the insulating structure 26 would extend down to approximately the position 66 which is located slightly above the first series of sheds 62. This semiconducting coating would normally be at ground potential. Another semiconducting coating would exist on the inside surface of the insulating structure 26 which defines the bore 50. This semiconducting coating would extend substantially the entire length of the insulating structure 26 and would acquire a potential substantially equal to the potential on the current-limiting fuse 32 and the conductor stud 54. Thus, the sheds 62 effectively provide longer creepage paths between the grounded semiconducting coating on the outside of the insulating structure 26 and the high potential semiconducting coating on the inside of the insulating structure 26.

Figure 3:
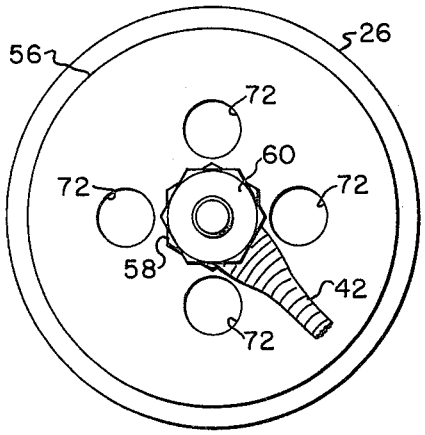
FIG. 3 is a bottom view of the current-limiting bushing assembly illustrating the arrangement of the retaining washer.

In order to prevent contact between the conductor stud 54 or the cap 52 and the interior surface of the insulating structure 26 and the semiconducting coating disposed thereon, a cylindrical sleeve 70 is disposed within the bushing assembly in the region where the diameter of the bore 50 is enlarged. The cylindrical sleeve 70 may be constructed of any suitable insulating material, such as a glass reinforced polyester. The sleeve 70 is held in position by the retaining washer 56 which may also be constructed of a similar material. As shown in FIG. 3, the openings 72 in the retaining washer 56 allow for the liquid dielectric in the transformer 10 to enter into the region between the lower end 40 of the current-limiting fuse 32 and the retaining washer 56. Although the orientation of the bushing 12 is not exactly perpendicular to the dielectric level within the transformer 10, the dielectric level generally would maintain a position somewhere between the lower end 40 of the fuse 32 and the region 66 above the shed 62, such as the indicated dielectric level 74. Having the dielectric or oil level 74 positioned as shown in FIG. 3 above the sheds 62 increases the effectiveness of the sheds 62 by increasing the dielectric strength of the surrounding medium and thus increasing the flashover voltage level.

The specific construction arrangement illustrated in the specific embodiment of this invention permits the use of a current-limiting fuse within a bushing insulating structure without the mechanical support provided in prior art arrangements by a protective link. Satisfactory current interrupting characteristics are provided by using a full-range current-limiting fuse of the type which have recently been developed and are available commercially.

Since numerous changes may be made in the above-described apparatus, and since different embodiments of this invention may be made without departing from the spirit thereof, it is intended that all of the matter contained in the foregoing description, or shown in the accompanying drawing, shall be interpreted as illustrative rather than limiting.

I claim as my invention:

1. A fused bushing for distribution transformers, comprising:

a longitudinal insulating member having a bore extending therethrough;

an electrical terminal located at the top end of the insulating member;

a sealed, full-range current-limiting fuse positioned within said bore, said fuse having first and second ends with the first end electrically connected to said terminal;

a conductor stud partially located within said bore and having first and second ends with the first end of the stud attached to the second end of the fuse;

a retaining washer positioned across the bottom end of the insulating member, with the washer containing an opening through which the stud extends and openings which permit flow communication between the bore and the outside of the insulating member;

means for pulling the stud through the opening in the washer; and a cylindrical sleeve constructed of an insulating material, said sleeve being positioned between the second end of the fuse and the inside surface of the insulating member.

2. The bushing of claim 1 wherein the diameter of the bore through the insulating member is larger in the region generally adjacent to the cylindrical sleeve than in the region generally non-adjacent to the cylindrical sleeve.

* * * * *